United States Patent [19]

Kinoshita et al.

[11] Patent Number: 4,647,136

[45] Date of Patent: Mar. 3, 1987

[54] MODULAR PLUG AND PRINTED CIRCUIT CONNECTOR

[75] Inventors: Yoshichika Kinoshita, Katsuta; Noriyasu Suzuki, Mito, both of Japan

[73] Assignee: Mitsumi-Cinch, Ltd., Tokyo, Japan

[21] Appl. No.: 708,251

[22] Filed: Mar. 5, 1985

[30] Foreign Application Priority Data

Mar. 7, 1984 [JP] Japan ..... 59-32430[U]

[51] Int. Cl.[4] ..... H01R 9/09; H01R 9/03

[52] U.S. Cl. ..... 339/125 R; 339/176 M; 339/176 MP

[58] Field of Search ..... 339/17 LC, 125 R, 126 R, 339/126 RS, 176 M, 176 MP

[56] References Cited

U.S. PATENT DOCUMENTS

| | | | |
|---|---|---|---|
| 3,413,594 | 11/1968 | Fernald et al. | 339/17 LC |
| 3,535,675 | 10/1970 | Baumanis | 339/125 R |
| 4,239,316 | 12/1980 | Spaulding | 339/176 M |
| 4,379,609 | 4/1983 | Hardesty | 339/176 M |
| 4,497,526 | 2/1985 | Myers | 339/176 M |
| 4,527,849 | 7/1985 | Marach | 339/125 R |
| 4,533,202 | 8/1985 | Pohl | 339/176 MP |
| 4,602,842 | 7/1986 | Free et al. | 339/176 MP |

FOREIGN PATENT DOCUMENTS

| | | | |
|---|---|---|---|
| 2368810 | 6/1978 | France | 339/176 MP |

*Primary Examiner*—Gil Weidenfeld
*Assistant Examiner*—Gary F. Paumen
*Attorney, Agent, or Firm*—Roberts, Spiecens & Cohen

[57] ABSTRACT

A connector comprises a connector housing provided with a plug inserting opening which accepts the insertion of a plug at the front surface of the connector housing and a slit which accepts the insertion of a printed circuit board at the rear surface of the connector housing. The connector further comprises an electrically conductive member which is secured to the connector housing. The electrically conductive member comprises a first contact part and a second contact part, and the first contact part projects within the plug insertion space to achieve contact with the plug while the second contact part is provided at the slit to achieve contact with the contacts. The printed circuit board is fit into the slit which is provided to the rear surface of said connector housing.

1 Claim, 23 Drawing Figures

MODULAR PLUG AND PRINTED CIRCUIT CONNECTOR

BACKGROUND OF THE INVENTION

The present invention generally relates to connectors, and more particularly to a connector which is used for connecting a telephone set to a telephone line.

Conventionally, connectors having fundamental parts thereof standardized in conformance with the FCC standard or the like are used to connect telephone sets to telephone lines. An example of the connector of this kind has a box-shaped housing with a plug inserting opening on the front surface of the housing. When the telephone set is connected to the telephone line, a plug which is provided on an end of a telephone line is inserted into the plug inserting opening. A plurality of contact pins are embeddedly provided on the housing so that one end of each of the contact pins project from the bottom of the housing to constitute a terminal part and the other end of each of the contact pins project within the plug inserting opening of the housing to constitute a contact part. A plurality of electrodes provided on the plug make contact with the contact part when the plug is inserted into the plug inserting opening of the housing. The connector is placed on a printed circuit board which is secured to a main telephone body, in such a manner that the plug inserting opening is exposed to the outside of the main telephone body. The terminal part constituted by the contact pins projecting from the bottom of the housing is soldered to respective circuit patterns on the printed circuit board.

In this arrangement of the conventional connector, the overall height of the connector in use is the sum of the height of the connector itself and the thickness of the printed circuit board, and is relatively large. For this reason, it is difficult to accommodate connector within a limited space. Consequently, there is a problem in that it is difficult to accommodate the connector within a telephone set having a thin configuration.

SUMMARY OF THE INVENTION

Accordingly, it is a general object of the present invention to provide a novel and useful connector in which the problems described heretofore are eliminated.

Another and more specific object of the present invention is to provide a connector having a slit part formed at an intermediate height position of a connector housing, which slit part is inserted with a printed circuit board so as to connect the connector and the printed circuit board. According to the connector of the present invention, the thickness of the printed circuit board is included in the height of the connector itself in a state where the connector and the printed circuit board are connected. Hence, it is possible to accommodate the connector within a space having a height corresponding to the height of the connector itself, which height of the connector itself includes the thickness of the printed circuit board. Therefore, the connector of the present invention can be applied to a telephone set having such a thin configuration that an internal space thereof is small.

Other objects and further features of the present invention will be apparent from the following detailed description when read in conjunction with the accompanying drawings.

DETAILED DESCRIPTION

Figure 1:
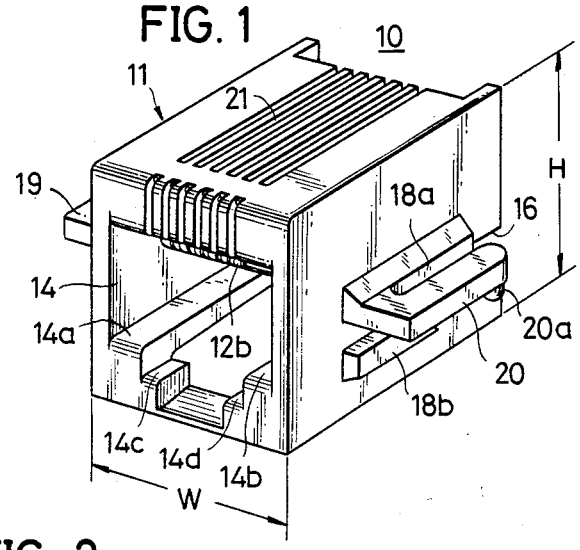
FIG. 1 is a perspective view showing a first embodiment of a connector of the present invention.
Figure 2:
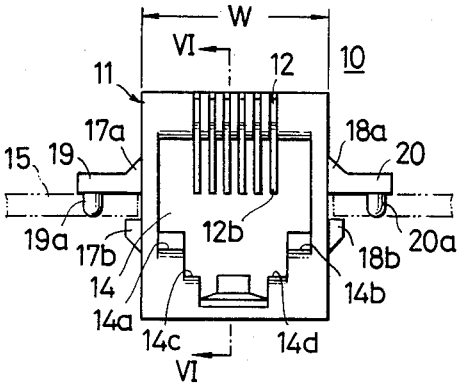
FIGS. 2 through 5 are respectively a front view, a plan view, a rear view and a side view of the connector shown in FIG. 1.
Figure 4:
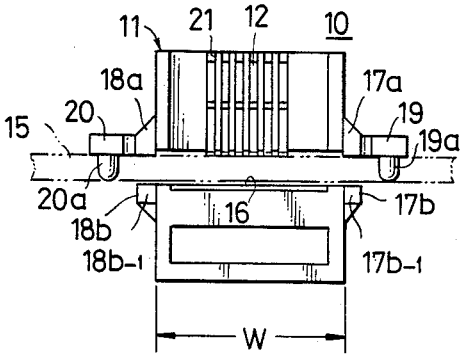
Figure 3:
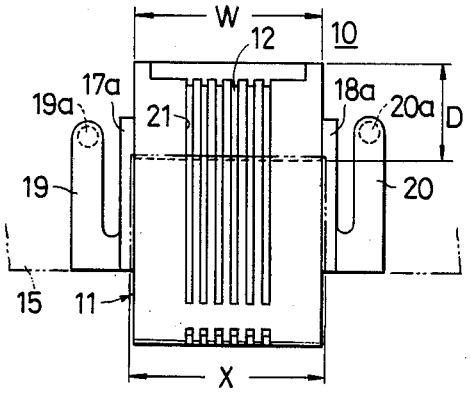

FIGS. 1 through 6 respectively show a first embodiment of the connector of the present invention. A connector 10 comprises an approximately box-shaped connector housing 11 having a width W and a height H, and six contact pins 12 mounted on the housing 11. The six contact pins 12 are electrically conductive members. The housing 11 is a symmetrical structure with respect to the right and left thereof.

The box-shaped housing 11 is made of formed plastics. The housing 11 is provided with a plug inserting opening 14 on the front surface thereof. A plug 13 provided at an end of a telephone line is inserted into the plug inserting opening 14 as indicated by a two-dot chain line in FIG. 6. The housing 11 is provided with a slit 16 at an intermediate part of the rear surface thereof. A printed circuit board 15 shown in FIGS. 7A and 7B is inserted into the slit 16. The slit 16 cuts into the side surfaces of the housing 11 for a length D which corresponds to the depth of the insertion of the printed circuit board 15 with respect to the housing 11. The plug inserting opening 14 is provided, as in the case of the conventional connector, with steps 14*a* and 14*b* for guiding the plug 13, and stoppers 14*c* and 14*d* for locking the inserted plug 13 within the plug inserting opening 14.

Ribs 17*a*, 17*b*, 18*a* and 18*b* are formed on the outer side walls of the housing 11 at positions corresponding to the slit 16. The printed circuit board 15 is pinched between a first pair constituted by the ribs 17*a* and 17*b* and a second pair constituted by the ribs 18*a* and 18*b*. The upper ribs 17*a* and 18*a* are provided with arms 19 and 20 which extend along the outer side walls of the housing 11, respectively. At the distal end of the arms 19 and 20 are provided projections 19*a* and 20*a*, respectively, for engaging the inserted printed circuit board 15. The arms 19 and 20 are shaped so that the arms 19 and 20 can be deformed resilently.

Figure 5:
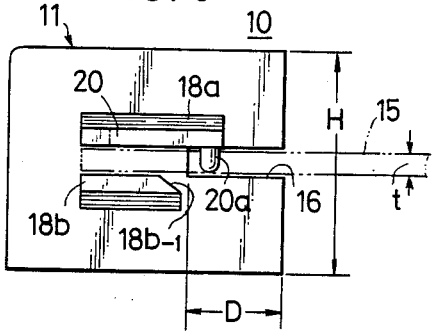

The upper ribs 17*a* and 18*b* and the lower ribs 17*b* and 18*b* are disposed in a parallel relationship to each other, and the lower ribs 17*b* and 18*b* are shorter than the corresponding upper ribs 17*a* and 18*a* as shown in FIG. 5. The lower ribs 17*b* and 18*b* terminate at positions which are slightly offset to the front of the housing 11 with respect to the positions of the respective projections 19*a* and 20*a*. Sloping surfaces 17*b*-1 and 18*b*-1 are formed on the lower ribs 17*b* and 18*b* where the lower ribs 17*b* and 18*b* terminate.

Six narrow grooves are formed on the upper surface, front surface and the rear surface of the housing 11. The six narrow grooves are disposed in parallel relationship to each other for accommodating the six contact pins 12. The contact pins 12 are not rod-shaped members having circular cross sections but are flat elongated members which are inexpensive compared to the former. The six contact pins 12 are fitted into the respective six grooves and are bent along the outer surface of the housing 11. The contact pins 12 penetrate holes 23 which are provided at the upper surface of the housing 11 near the front surface of the housing 11. U-shaped bent parts 12*a* of the contact pins 12 are forcibly inserted into depressions 23 provided on the rear surface of the housing 11. The pins 12 are secured to the housing 11 at two positions, that is, at the front surface and the rear surface of the housing 11.

Figure 6:
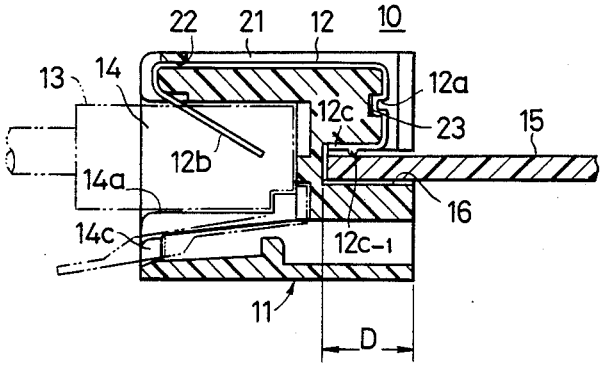
FIG. 6 is a cross section of the connector along a line VI—VI in FIG. 2.
Figure 7A:
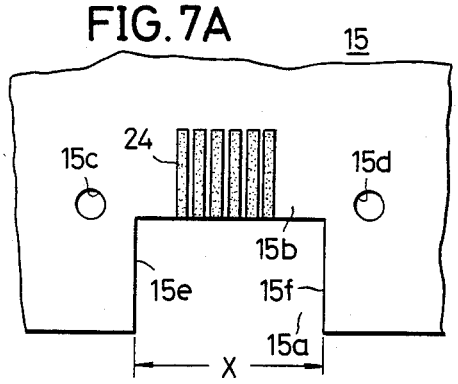
FIGS. 7A and 7B are respectively a plan view and a front view of a part of a printed circuit board which is connected to the connector shown in FIG. 1.
Figure 7B:
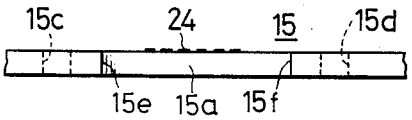

As shown in FIG. 6, one end of each of the contact pins 12 projects into the plug inserting opening 14 and a first contact part 12*b* is constituted by the one end of each of the contact pins 12. The first contact part 12*b* can make contact with the plug 13. The other end of each of the contact pins 12 is exposed at the slit 16 and a second contact part 12*c* is constituted by the other end of each of the contact pins 12. The second contact part 12c can make contact with contacts 24 provided on the printed circuit board 15. The second contact parts 12*c* comprises projections 12*c*-1 for ensuring positive electrical contact.

The printed circuit board 15 is secured within a main body telephone set. As shown in FIGS. 7A and 7B, the printed circuit board 15 has the plurality of contacts 24 at an inner part 15*b* of an U-shaped cutout 15*a*. The width X of the cutout 15*a* is slightly larger than the width W of the housing 11 so as not to interface with the insertion of the printed circuit board 15 into the housing 11. The printed circuit board 15 also has a pair of openings 15*c* and 15*d* at the left and the right side of the U-shaped cutout 15*a*.

The above mentioned connector 10 accommodates the above mentioned part 15*b* of the printed circuit board 15 within the slit 16 when the printed circuit board 15 is inserted into the housing 11. The projections 19*a* and 20*a* engage with the respective openings 15*c* and 15*d* and lock the inserted printed circuit board 15 to the housing 11. Both side edges 15*e* and 15*f* of the U-shaped cutout 15*a* of the printed circuit board 15 are supported between the pair constituted by the ribs 17*a* and 17*b* and the pair constituted by the ribs 18*a* and 18*b*. The mounting of the printed circuit board 15 to the housing 11 is easily performed by a simple insertion of the circuit board 15 into the housing 11 and requires no soldering.

The mounting of the printed circuit board 15 to the housing 11 can be performed by first bending the arms 19 and 20 upwardly, making the projections 19*a* and 20*a* contact the upper surface of printed circuit board 15 in vicinities of the side edges 15*e* and 15*f*, and then fully inserting the printed circuit board 15 into the housing 11. During the insertion, the printed circuit board 15 is pushed downwardly by the projections 19*a* and 20*a*. Since the lower ribs 17*b* and 18*b* do not extend up to the positions corresponding to the projections 19*a* and 20*a*, the portion of the printed circuit board 15 which is adjacent to the cutout 15*a* is slightly bent downwardly. The bends in the arms 19 and 20 are reduced by the amount of the slight bend of the printed circuit board 15, the urging forces exerted by the projections 19*a* and 20 on the upper surface of the printed circuit board 15 are also reduced. Thus, the frictional force between the printed circuit board 15 and the projections 19*a* and 20*a* is reduced, and only a small force is required to insert the housing 11 into the circuit board 15. The bent end part of the printed circuit board 15 is guided along the sloping surfaces 17*b*-1 and 18*b*-1 of the ribs 17*b* and 18*b*, and is inserted between the ribs 17*a* and 17*b* and the ribs 18*a* and 18*b*. Hence, the insertion of the printed circuit board 15 into the connector 10 is carried out smoothly.

In the state where the connector 10 and the printed circuit board 15 are secured together, the projections 12*c*-1 of the second contact part 12*c* make contact with the contacts 24 of the printed circuit board 15. The connector 10 which is secured to the printed circuit board 15 is assembled within the main telephone body so that the entrance portion of the plug inserting opening 14 is exposed to the outside of the telephone set at an appropriate part, such as the rear surface of the main telephone body.

The plug 13 provided at the end of the telephone line is inserted into the plug inserting opening 14 under the guidance of the steps 14*a* and 14*b* as shown in FIG. 6. When the plug 13 is fully inserted, the plug 13 is locked by the stoppers 14*c* and 14*d*. As indicated by a two-dot chain line in FIG. 6, the first contact part 12*b* of the contact pins 12 is bent by the contact between the contacts (not shown) of the plug 13. In this way, the electrical contact is achieved between the telephone set and the telephone line.

According to the connector 10 having the construction described heretofore, the thickness t of the printed circuit board 15 is included in the overall height H of the connector 10. Therefore, the overall thickness H of the connector 10 is equal to the height of the housing 11. Thus, in order to accommodate the connector 10 and the printed circuit board 15, it is sufficient to have the space with the height H. The connector according to the present invention is therefore suitable for use in the telephone sets because of thin configurations.

Figure 8A:
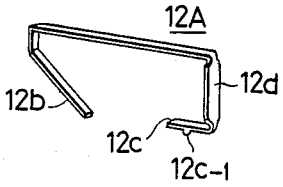
FIGS. 8A and 8B are respectively perspective views of modifications of contact pins which may be applied to the connector shown in FIG. 1.

As an alternative to the contact pins 12, one can use other contact pins 12A as shown in FIG. 8A. Instead of the U-shaped bent parts 12*a*, each of the contact pins 12A has a widened part 12*d* which is slightly wider than the width of the narrow grooves 21 into which the contact pins 12A are fitted. The advantage of using the contact pins 12A is that it is not necessary to form the U-shaped bent parts 12*a* as in the case of the contact pins 12 by means of press forming, and the fabrication cost is reduced.

Figure 8B:
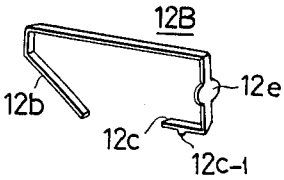

It is further possible to use contact pins 12B shown in FIG. 8B instead of the contact pins 12. The contact pins 12B are identical to the contact pins 12A except for the widened part 12*e* which is only formed on a part of each of the contact pin 12B. The widened part 12*e* of each of the contact pins 12B can easily be pressed into the narrow groove 21 and secured firmly therein, as in the case of the contact pins 12A.

Next, descriptions will be given with respect to other embodiments of the connector of the present invention in conjunction to FIGS. 9 through 21. The constructions of the connectors in these embodiments are basically the same as those described in the first embodiment. Therefore the parts or components which are already described in FIGS. 1 through 7 are designated by the same reference numerals with or without the addition of a subscript A, B, C, D or E and the description thereof will be omitted.

Figure 9:
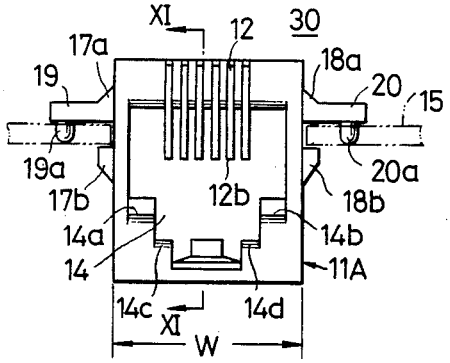
FIGS. 9 and 10 are respectively a front view and a side view of a second embodiment of the connector of the present invention.
Figure 10:
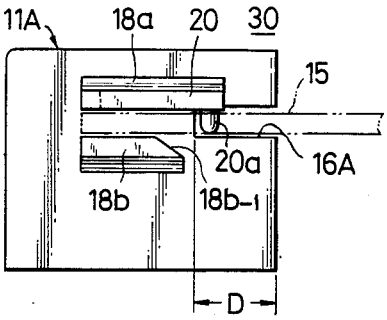
Figure 11:
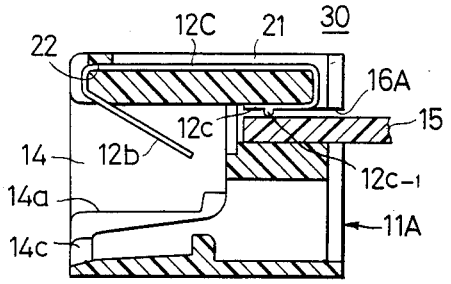
FIG. 11 is a cross section of the connector along a line XI—XI in FIG. 9.
Figure 12:
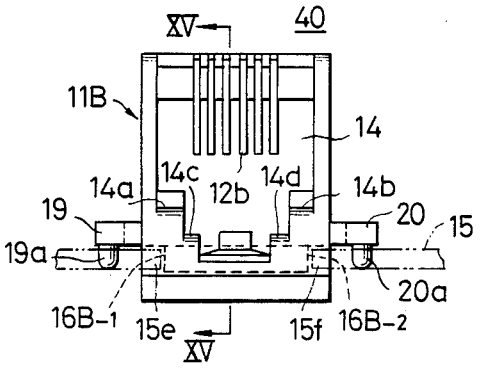
FIGS. 12, 13 and 14 are respectively a front view, a plan view and a side view of a third embodiment of the connector of the present invention.
Figure 14:
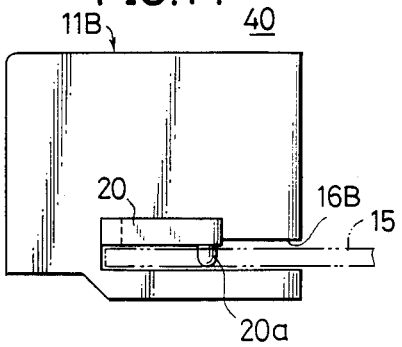
Figure 13:
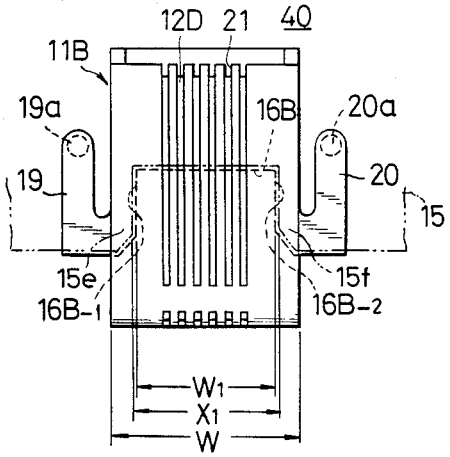
Figure 15:
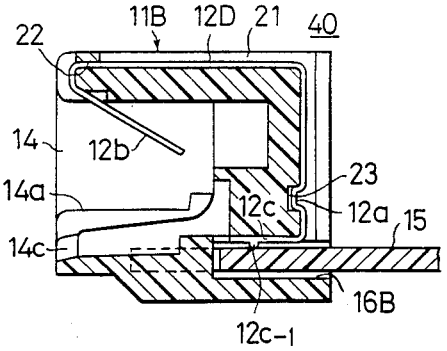
FIG. 15 is a cross section showing the connector along a line XII—XII in FIG. 12.
Figure 16:
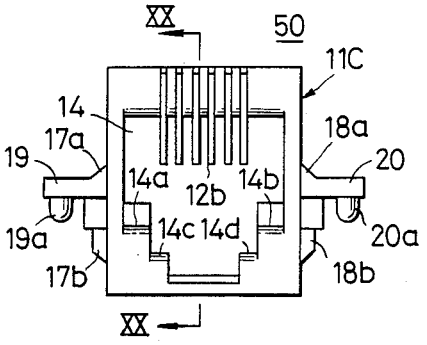
FIGS. 16 through FIG. 19 are respectively a front view, a plan view, a rear view and a side view of a fourth embodiment of the connector of the present invention.
Figure 19:
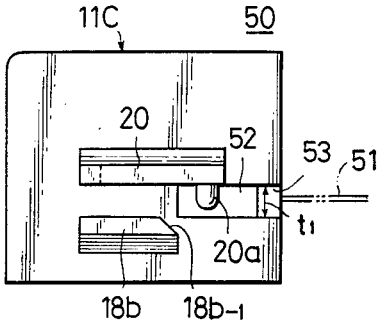
Figure 17:
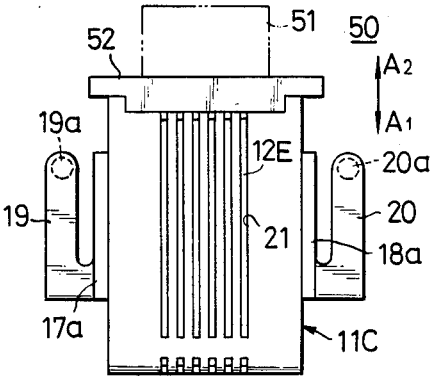

FIGS. 9 through 11 show a connector 30 which is the second embodiment of the present invention. In the connector 30, a slit 16A is provided at the rear surface of a connector housing 11A near the upper surface. In this embodiment, the length of contact pins 12C which run vertically at the rear surface of the connector housing 11A is short. The contact pins 12A are not provided with the U-shaped bent parts in contrast with the contact pins 12 in the first embodiment. The housing 11A is also not provided with the depression in the rear surface in contrast to the housing 11 in the first embodiment. In this configuration, the contact pins 12A can be firmly secured to the housing 11A without the U-shaped bent parts 12*a* and the depressions 23 which are employed in the first embodiment for the purpose of securing the contact pins 12 to the housing 11.

FIGS. 12 through 15 show a connector 40 which is the third embodiment of the present invention. In the connector 40, a slit 16B is provided at the rear surface of the connector housing 11B near the bottom surface. The slit 16B is also extended to both the side surfaces of the housing 11 as grooves 16B-1 and 16B-2. Ribs 17*a*, 17*b*, 18*a*, and 18*b* of the first embodiment are not provided. In this embodiment, the printed circuit board 15 is provided with the U-shaped cutout with the width $X_1$ which is smaller than the width W of the housing 11. Thus, the printed circuit board 15 is connected to the connector 40 in a manner that the portions of the side edges 15*e* and 15*f* are held within the grooves 16B-1 and 16B-2, respectively. The depth of the grooves 16B-1 and 16B-2 are determined by the width W of the housing 11 and the width $W_1$ shown in FIG. 13, in which $W_1$ is slightly larger than $X_1$ to allow the accommodation of the printed circuit board 15 to the housing 11. The housing 11B is provided with contact pins 12C.

FIGS. 16 through 21 show a connector 50 which is the fourth embodiment of the present invention. This connector 50 is designed to accept the insertion of a flexible printed circuit sheet (FPC) 51.

Figure 20:
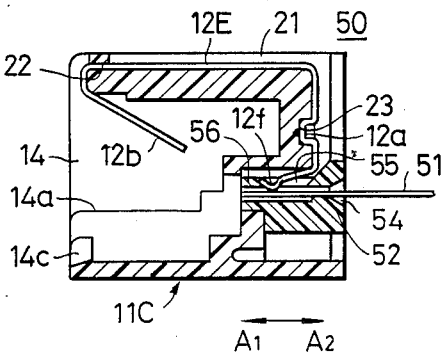
FIG. 20 is a cross section of the connector along a line XX—XX in FIG. 16.
Figure 18:
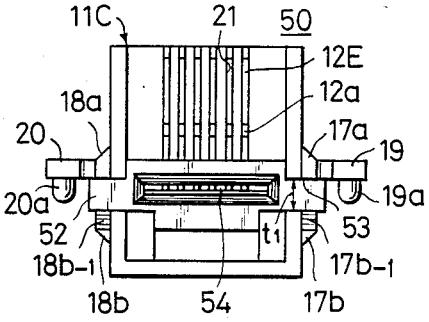

A movable member 52 engages a space 53 which is provided to the rear surface of a housing 11C in a movable manner in the directions as shown by arrows $A_1$ and $A_2$. The movable member 52 is provided with a slit shaped opening 54 to which the FPC 51 is inserted. As can be seen from FIG. 20, there is provided a space 55 above the movable member 52 for the purpose of accommodating the second contact part 12*f*. FIG. 20 also shows a sloping guiding part 56 which guides the second contact part 12*f* above the movable member 52. The movable member 52 is further provided with an accommodating space 57 which accepts the end of the FPC 51. The space 57 communicates to the opening 54 as well as to the space 55.

Figure 21:
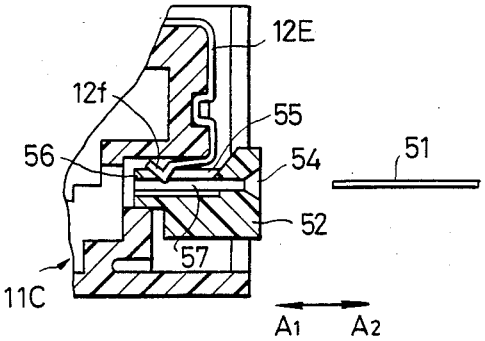
FIG. 21 is a cross section showing a part of the connector in FIG. 20 on an enlarged scale showing the setting state of a movable member when the printed circuit sheet is inserted into the connector.

When the FPC 51 is to be connected to the connector 50, the movable member 52 is slightly drawn out in the direction shown by the arrow $A_2$ in FIG. 21. The second contact part 12*f* of the contact pin 12E is then guided upwardly by the sloping guiding part 56 and is disengaged from the space 57 as shown in FIG. 21. In this state, the FPC 51 is then inserted through the opening 54. This insertion is carried out without requiring a pushing force. After the insertion of the FPC 51 is achieved, the movable member 52 is pushed into the housing 11 in the direction of the arrow $A_1$ as shown in FIG. 20. Then, the connector 50 assumes the state shown in FIG. 20 in which the second contact part 12*f* is disengaged from the sloping guiding part 56 and partly projects within the space 57 from the space 55. Thus, the FPC 51 is clamped by the second contact member 12*f* and the electrical connection is achieved.

In this embodiment, the height $t_1$ of the space 53 is equal to the thickness t of the printed circuit board 15. Therefore, by removing the movable member 52, the connector 50 can also be connected to the printed circuit board 15 in the same way as described previously.

As can be seen from the drawings, the connectors 30, 40, 50, and 60 which are the second, third and fourth embodiments of the present invention, respectively, do not cause the increase of the overall thickness of the connector. Therefore, the connectors in these embodiments are also suitable for use in the telephone sets with thin configurations. The connectors 10, 30, 40, and 50 can also be employed for the connection of the cables from the telephone set to the hand set.

Further, the present invention is not limited to these embodiments, but various variations and modifications may be made without departing from the scope of the present invention.

What is claimed is:

1. A connector comprising:

a connector housing having upper, front and rear surfaces and being provided with a plug insertion opening at said front surface for insertion of a plug and a slit at said rear surface for insertion of a printed circuit board, said printed circuit board having a plurality of contacts, said connector housing being provided with a plurality of grooves extending along said upper surface and said rear surface of said connector housing and an upper surface of said slit;

a plurality of electrically conductive members each of which comprises a part fitted into a corresponding one of said plurality of grooves, a first contact part and a second contact part, said first contact part projecting within said plug insertion opening in a position to contact said plug when the latter is inserted into said plug insertion opening, said second contact part being provided at said upper surface of said slit in a position to achieve contact with one of said contacts on the printed circuit board when the latter is inserted into said slit; and a pair of guide members on respective opposite side surfaces of said connector housing for guiding said printed circuit board when said printed circuit board is inserted into said slit, each of said guide members comprising a pair of ribs, respectively, at positions corresponding to said slit, each of said pair of ribs being constituted by an upper rib and lower rib disposed in parallel with a spacing which corresponds to the thickness of said printed circuit board, said printed circuit board being inserted into said slit by pushing said printed circuit board between said second contact part and a lower surface of said slit, and said second contact part makes contact with one contact from a plurality of contacts formed at an inner part of a U-shaped cutout of said printed circuit board, said connector further comprising a pair of resiliently deformable cantilevered arms respectively on the opposite side surfaces of the connector housing, each of said arms having a distal end with a projection at said distal end and being bent upwardly when said printed circuit board is being inserted into said slit in said connector housing, and after insertion is completed said arms recovering resiliently such that said projection engages one of a plurality of openings which are provided in said printed circuit board and arranged on opposite sides of said U-shaped cutout, said lower rib of each guide member having a rear end which is located at a position closer to the front surface of said connector housing than the position of said projection.

* * * * *